US006800007B2

(12) United States Patent
Calkin

(10) Patent No.: US 6,800,007 B2
(45) Date of Patent: Oct. 5, 2004

(54) WEARABLE PERSONAL EMERGENCY RESCUE APPARATUS

(76) Inventor: Carston R. Calkin, P.O. Box 230487, Portland, OR (US) 97281

( * ) Notice: Subject to any disclaimer, the term of this patent is extended or adjusted under 35 U.S.C. 154(b) by 0 days.

(21) Appl. No.: 10/613,578

(22) Filed: Jul. 2, 2003

(65) Prior Publication Data

US 2004/0023574 A1 Feb. 5, 2004

Related U.S. Application Data

(60) Provisional application No. 60/393,415, filed on Jul. 3, 2002.

(51) Int. Cl.[7] ..... B63C 9/26
(52) U.S. Cl. ..... 441/84; 441/80
(58) Field of Search ..... 441/80–85, 88, 441/106; 182/3, 70; 383/6, 13

(56) References Cited

U.S. PATENT DOCUMENTS 2,192,203 A * 3/1940 Purdy ..... 441/85
3,676,882 A * 7/1972 Lindqvist ..... 441/85
4,560,356 A * 12/1985 Burr ..... 441/80
4,688,674 A * 8/1987 Stirtz ..... 206/388
4,713,033 A * 12/1987 Cameron ..... 441/84
4,714,135 A * 12/1987 Bell et al. ..... 182/6
4,836,815 A * 6/1989 Spurgeon ..... 441/84
5,540,178 A * 7/1996 Damron ..... 114/362
5,868,219 A * 2/1999 Sadeck et al. ..... 182/70
6,257,942 B1 * 7/2001 Groover ..... 441/84
6,487,725 B1 * 12/2002 Jordan ..... 2/94
6,568,976 B2 * 5/2003 Anderson et al. ..... 441/80
6,679,743 B1 * 1/2004 Gerber ..... 441/84

* cited by examiner

*Primary Examiner*—S. Joseph Morano
*Assistant Examiner*—Ajay Vasudeva
(74) *Attorney, Agent, or Firm*—Olson & Olson

(57) ABSTRACT

A personal wear throw bag lifeline rescue apparatus provides a lifeline-containing bag member arranged for quick release attachment to a wearer, the lifeline being secured at one of its ends to the interior of the bag member and arranged at its opposite outer, free terminal end for secure attachment to the wearer, whereby in an emergency situation the bag member may be grasped and pulled off of the wearer and thrown, carried or otherwise moved to a distant location defined by the overall length of the lifeline cord where a rescuing person may pull on the lifeline to pull the wearer connected to the lifeline to safety.

7 Claims, 2 Drawing Sheets

WEARABLE PERSONAL EMERGENCY RESCUE APPARATUS

This application claims benefit under 35 U.S.C. 119(e) of U.S. Provisional application Ser. No. 60/393,415, filed Jul. 3, 2002.

BACKGROUND OF THE INVENTION

This invention relates to throw bag type lifeline rescue devices, and more particularly to a lifeline throw bag apparatus arranged to be attached to and worn with the safety gear apparel worn by military and rescue personnel and provide an emergency extrication apparatus that advantageously combines a throw bag lifeline and a rappelling carabiner into a single, wearable unit for emergency use by an injured or trapped personnel in situations which require his expedient extrication or escape from an immediately dangerous scene.

Throw bag type lifelines have been provided heretofore and typically have provided rather large, bulky cord-containing bags provided as rescue equipment kept in boats, at swimming areas and the like and which, while holding onto the free end of the lifeline cord, a person can throw the bag toward a swimmer in trouble who typically must then attempt to get to the bag and grab onto it whereupon the thrower of the bag then pulls the person to safety, much as in the case of the long recognized rope-tethered life rings thrown to people at risk in the water. Such typical throw bag lifeline arrangements are shown in U.S. Pat. No. 4,713,033 (Cameron); U.S. Pat. No. 4,836,815 (Spurgeon) and U.S. Pat. No. 6,257,942 (Groover). All of these devices teach arrangements which are stored away until needed; thrown by a rescuer to a person in need of assistance; and rely on the accuracy of the thrower and the effort and ability of the victim to obtain and hold onto the thrown bag and lifeline when being pulled to safety. Such devices, even though they suffer the shortcoming of relying on the capabilities of the victim, do provide a valuable utility in public areas and situations where their use is rare and intended for providing general safety equipment for any person in that area needing assistance.

However, as is well known, various personnel, particularly those engaged in high risk occupations, may easily and unexpectedly find themselves in extremely dangerous and precarious situations at a moment's unexpected notice. Military personnel may be shot or otherwise injured during battlefield exchanges or movements, as may also paramilitary personnel such as police, swat or assault teams in the course of their duties. Firefighters and other rescue personnel may find themselves trapped in precarious locations high above ground after other avenues of exit have been cut off, or those exits themselves have become a more dangerous escape route than even an unplanned rappel down the outside of a building or other height.

In a situation where a soldier or a police officer might be injured and downed by gunfire for example, it is easy to recognize that it is of paramount importance that the injured man be removed from the line of fire at the immediate scene not only for his need for treatment, but also to remove him from the peril of additional gunshot injury or death. But, by the same token, in coming to his aid to drag the injured man to safety, his rescuers place themselves into the very same, extremely dangerous and vulnerable position of being shot and injured or killed themselves in the effort.

Obviously therefore, very important benefits will be achieved by the provision of anything that can help facilitate the extrication of an injured or trapped individual in any such situation and particularly so if it also assists in reducing or avoiding the need for the exposure of rescuers to the extreme danger of that immediate scene during the extrication of the injured man to a safer location.

SUMMARY OF THE INVENTION

In its basic concept, this invention provides a personal throw bag lifeline rescue apparatus in the form of a lifeline-containing pouch which is arranged to be attached in quick release fashion to the wearing apparel of rescue and military personnel with the free terminal end of the lifelined being securely attached to the safety apparel of the wearer whereby in an emergency, the throw bag may be grasped and immediately pulled from its releasable attachment to the wearer and thrown, carried or otherwise moved to a remote location where another person may grab the lifeline and pull the person to safety by virtue of the fixed securement of the lifeline to the safety harness or other safety apparel worn by the personnel from whom the throw bag had been removed.

It is by virtue of the basic concept that the principal objective of this invention is achieved; namely, the provision of a personal wearable throw bag lifeline rescue apparatus arranged to assist and facilitate the wearer's emergency removal from a dangerous situation.

Another object and advantage of this invention is the provision of a personal wearable throw bag lifeline rescue apparatus of the class described which removably secures the opposite terminal end of the lifeline to the interior of the throw bag through a snap ring such as a carabiner secured removably within the confines of the throw bag, whereby to permit use of the lifeline and carabiner, separated from the throw bag, for repelling use of the lifeline and carabiner if required in an emergency situation.

Another object of this invention is the provision of a personal, wearable throw bag lifeline rescue apparatus of the class described in which the throw bag is formed of an inherently buoyant material, such as closed cell neoprene, for advantageous use by divers and water rescue personnel.

A still further object of this invention is the provision of a personal wearable throw bag lifeline rescue apparatus of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figures 1, 2:
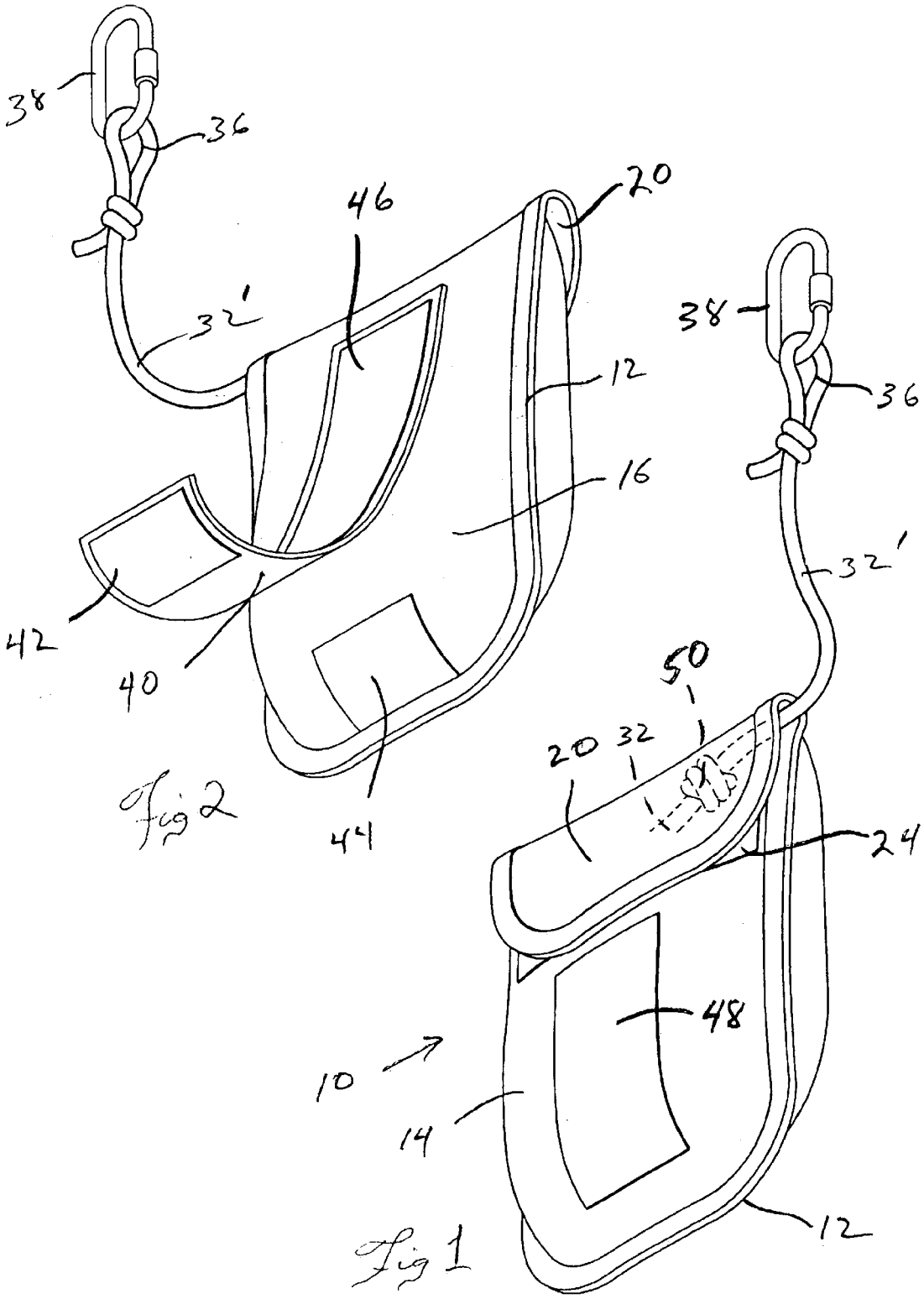
FIG. 1 is a perspective view of the front side of a wearable personal emergency extrication apparatus embodying features of this invention in ready condition for releasable attachment to a wearer.
FIG. 2 is a perspective view of the back side of the apparatus as viewed from the opposite direction in FIG. 1.

As shown, the personal extrication apparatus 10 of this invention includes a preferably flexible bag member 12 or pouch having a front panel 14 and a rear panel 16 secured together so as to form an enclosed, substantially hollow interior cavity having an open top end 18 which is releasably closable by a cover flap member 20. As shown, the cover flap preferably is releasably secured in covering condition overlying the open top end 18 of the bag by corresponding components 22, 24 of a quick disconnect, hook and loop type fastener secured to confronting face surfaces of the flap member 20 and panel 14 as seen best in FIG. 3. Hook and loop type fasteners are well known in the fastening art, those identified by the trademark VELCRO® being most widely recognized by the general consumer. The bag member itself may be formed of any suitable, durable material as may be desired, such as canvas, cordura or the like with heavy duty stitching to assure its long and reliable life as part of the standard wear of the various military and emergency personnel for which the invention is intended. Preferably for water operations the bag is formed of a closed cell foam material such as neoprene. This material, known for its use in diver's wet suits, is not only strong, flexible and durable, it inherently has a strongly positive buoyancy which provides an advantage which will be discussed later.

Figures 3, 4:
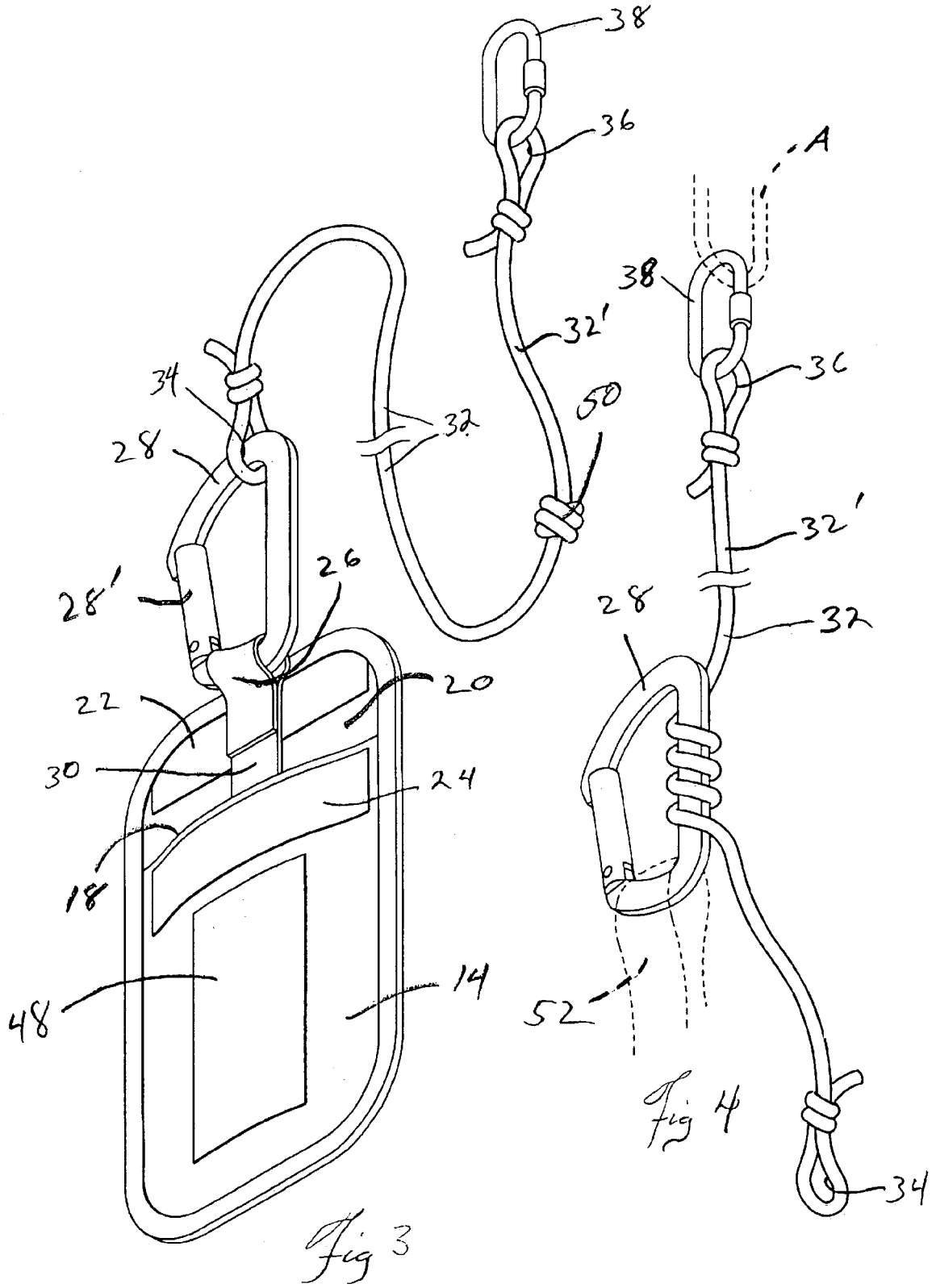
FIG. 3 is a foreshortened perspective view of the apparatus of FIG. 1 illustrating the apparatus in a substantially deployed condition to show the various components of the apparatus.
FIG. 4 is a foreshortened perspective view showing the carabiner and the cord of the apparatus separated from the bag member for rappelling use of the carabiner and cord.

Also, as seen best in FIG. 3, a webbing loop member 26 or ring member is secured within the inner confines of the bag during its manufacture, this loop member providing means for securing a carabiner 28 releasably within the interior of the bag member as can be understood in viewing FIG. 3. The webbing loop member 26 may be formed, as shown, of strap material 30 securely stitched at one terminal end to the bottom interior of the bag member, the strap being folded over and stitched together adjacent its opposite end to form a loop member 26 which receives the carabiner as illustrated. Other loop arrangements may alternatively be provided if desired, such as the securing of a metal ring (not shown) within the bag member.

In the preferred embodiment illustrated herein, a cord 32 or rope having a predetermined length is provided with loops 34, 36 at its opposite terminal ends. These end loops may be provided by any suitable manner such as by the knot tying of the cord 32 as is illustrated herein or, if desired, by sewing, or swagging the loops into the cord, or by securing separate end ring fixtures (not shown) to the terminal ends of the cord. In any case, the loop 34 is configured to freely receive the carabiner 28 clipped therethrough as shown in FIG. 3, and the loop 36 at the opposite terminal end of the cord is arranged to freely receive a releasable connector member such as a carabiner, snap loop or the screw link type fastener 38 shown in FIGS. 1–4.

While the overall length of the cord 32 is preferably approximately 30 feet, which is believed to be suitable for situations anticipated by this invention, the length of the cord may of course be longer or shorter as may be desired or needed. In any case, it is to be understood by those skilled in the art that the bag member 12 is configured with an interior cavity dimensioned sufficiently to hold and enclose the carabiner 28 secured to the loop member 26, as well as also the entire length of the cord 32 secured at one of its loop ends 34 to the carabiner, entirely within the confines of the bag member.

In this regard, it has been determined that the cord 32 should be packed into the bag in random, stuffed condition filling the bag from bottom to top, and not inserted in a pre-coiled or pre-wound condition into the bag. This random packing of the cord into the bag assures that the cord will discharge from the bag in a continuous, tangle-free line for the purpose yet to be described.

Referring again to the bag member 12 itself, an open belt loop flap member 40 is secured to the back panel 16 of the bag member 12 as by stitching, rivets or other strong securement means provided along one longitudinal end of the belt loop flap member 40. As seen in FIG. 2, the top edge of flap member 40 is secured to the back panel 16 of the bag member while the bottom edge of the flap member is releasably secured, in quick disconnect manner, to the back panel by the provision of corresponding hook and loop type fastener members 42, 44 fixedly secured to the confronting surfaces of the flap member 40 and back panel 16.

As is apparent, when the hook and loop fastener members 42, 44 are pressed into interengagement with each other, a secure but quick-release belt loop is formed between the flap member 40 and the surface of the back panel 16 of the bag. Thus, the bag member may be easily secured to a waist belt, vest strap, utility suspender, safety harness or other similar article of safety clothing fixedly secured on emergency or military personnel. Most importantly however, it will also be apparent to those skilled in the art that the bag member secured thusly may also be immediately removed therefrom in quick-release fashion when needed, simply by grasping the bag body and applying a forceful pull on the bag sufficient to separate the hook and loop components 42, 44 and allow the bag to be pulled free of its belt or strap mount.

The extrication apparatus 10 of this invention also preferably mounts means for releasably mounting the bag member 12 in quick disconnect manner alternatively to a personnel's assault vest or other specialized safety wearing gear utilizing the standard hook and loop fastener sections typically provided on the assault vests and other specialized safety gear. In this regard, it is well understood that typical assault vests (not shown), firemen's safety coats and other such safety gear include exposed sections (not shown) of hook and loop type fastener components typically secured in a position overlying adjacent front sides of the wearer's chest below the shoulders; a length of hook component typically provided on one side of the chest and/or a length of loop component provided on the opposite side of the wearer's chest. These fastener components are provided to releasably mount various equipment having the corresponding fastener component applied thereto for quick release securement of various items to the front of the vest for easy access by the wearer.

Still with reference to conventional assault vest construction and the construction of other safety vest and harness type wearing gear or body armor, there is typically provided at least one safety webbing loop or ring member (not shown) securely attached to the vest or harness for the attachment of safety lines and the like temporarily to the wearer. One such fixed ring member is typically provided on the back of the vest beneath the neck of the wearer. This fixed ring (not shown) is the preferred attachment point for the fastener member on the terminal end of the cord (screw link 38 in this embodiment), as will become clear later.

As mentioned previously, releasable mounting of the bag member 12 to the hook and loop fastener sections provided on the safety vest structure is provided, and in this regard, the bag member 12 preferably securely mounts a strip of one fastener component 46 of a hook and loop type fastener on the back side of the bag member (on flap 40 in the embodiment illustrated), and mounts a strip of the other fastener component 48 on its front panel 14. In this manner, the bag member 12 may be quickly and securely attached directly to the vest utilizing whichever fastener component is provided or available on the vest worn by the safety personnel. By way of example, if the backside of the bag member 12 mounts a strip of hook material and the front panel of the bag member mounts a strip of loop material, and if the assault vest has a strip of loop material available for use, the bag member 12 is simply mounted to the vest by pressing the bag to the assault vest with the backside of the bag positioned over the loop component on the vest. Conversely, if the available fastener component on the vest is a section of hook component, then the bag is pressed onto the vest with its front surface panel 14 facing inwardly for engagement of loop component 48 with the corresponding fastener component on the assault vest, as is readily apparent. Clearly, once so attached the bag member 12 will remain secured to the vest until grabbed and intentionally pulled from the vest when needed.

Finally, means is provided for retaining a predetermined terminal end length portion 32' of cord 32 extending from the screw link fastener 38 in condition extended from the bag member, while preventing further unintended discharge of cord from the interior of the bag member when the cover flap 20 is in closed condition. As seen in FIGS. 1 and 3 of the drawings, this retaining means is provided in this embodiment by the tying of a knot 50 in the cord 32 at a predetermined point inwardly from the terminal end of the cord 32, the knot providing an enlargement in the cord that, when contained within the confines of the bag when the cover flap 20 is secured in condition overlying and closing the open end of the bag, as seen in broken lines in FIG. 1 of the drawings, provides an obstruction which prevents movement of the cord out of the bag as is readily apparent. The predetermined distance between the knot 50 and the fastener member 38 on the terminal end of the cord 32 is selected to correspond to the cord length needed between the attachment of the bag on the front of the assault vest or other safety gear and the connection of the fastener member 38 to the safety loop or ring member secured on the assault vest. For example, in the case of the bag member 12 being attached to the front of an assault vest approximate the chest of the wearer, and the screw link 38 being fastened to a safety ring member or webbing loop located as described centrally on the back of the vest beneath the wearer's neck, the predetermined length between the knot 50 and the screw link 38 is preferably approximately 16–18 inches. Alternatively to the knot 50, an adjustable ball fastener or ball lock (not shown) may be secured in position on the cord.

Accordingly, it will be understood by those skilled in the art that the present invention comprises a pouch or bag member releasably securing a carabiner within its interior, the carabiner serving to releasably mount one terminal end of an approximately 30 foot cord that is stuffed randomly into the bag which is releasably closed by a cover flap through which a terminal end portion of the cord extends from the bag and terminates in a releasable fastener member configured for attachment to a fixed loop or ring on a soldier's vest for example. The bag includes hook and loop type fastener components on its opposite faces configured for mounting engagement with corresponding loop or hook components typically provided on a soldier's vest. Releasable belt loop means is also provided for releasably securing the bag to a belt or strap member if needed or desired as an alternative mount.

In use, if the wearer is wounded, injured, or otherwise in need of pulled extriction from his location, he simply grabs the bag member 12 and pulls on it to separate it from its VELCRO®-type mount on the vest, belt or other safety harness or strap; pulls the cover flap 20 open, and throws the bag with the cord inside in the direction of another soldier who can then take hold of the line and drag the wounded soldier to a safer location by virtue of the fixed connection 38 of the line to the injured soldier's vest or harness. It will be apparent to those skilled in the art that the additional weight and mass of the carabiner secured within the bag contributes to the distance the bag may be thrown by a weakened, injured person, as well as adding weight that increases momentum for bouncing, rolling and sliding of the bag along a ground surface as well.

It will also be appreciated by those skilled in the art that in the event the wounded man is unconscious or otherwise incapable of throwing the bag due to injuries or incapacitation, a rescuing personnel may simply run to the downed man, grab the bag member 12 and pull it off of the downed man, and run off until the rope is extended from the bag sufficiently to place the rescuing personnel in a safer location, whereupon he may then pull the downed man to safety. This at the very least minimizes the amount of time the rescuing personnel is also exposed to the line of fire and in peril of being injured himself in the rescue of his comrade. Also of course, a personnel in a safe location may throw his bag to the injured man if necessary, for example if the injured man's throw fell short or errant of his intended target.

In the event that the wearer is trapped in a dangerous or precarious situation requiring his immediate rappelling to safety, the wearer disconnects the screw link 38 attachment of the cord to the ring of his vest and secures the end of the rope to the strongest available anchor point A at the scene of the emergency. He then pulls the rest of the rope out of the bag and unclips the carabiner from the loop 26 in the bag and connects the carabiner to his harness 52 as usual. The cord 32 is disconnected from the carabiner at loop 34 by opening the carabiner gate 28' and the cord is wrapped around the spine of the carabiner as is known in the rappelling art and seen in FIG. 4. The trapped personnel is then ready to emergency rappel to safety.

As mentioned previously, the bag member may be formed of a closed cell foam material such as neoprene for its inherently buoyant qualities. In this regard, the throw bag lifeline rescue apparatus of this invention also finds particular utility in connection with divers and other water based personnel wherein it can be easily seen that if a diver finds himself in trouble, he can pull the bag member free from himself, open the top flap and release the bag which will ascend to the surface. This provides an indicator to those on the surface of trouble below, and where the diver is, and also provides a line connection to the diver which other divers may follow for quickest arrival at the site of the trouble, and indeed by which persons at the surface may use to pull the diver to the surface if needed. Also in situations involving diving teams, in the event a team must await recovery at the surface of a body of water particularly in rough sea conditions often encountered by search and rescue personnel, the individual swimmers can pull the individual bag members free of themselves and pull their respective lifeline cords fully out of the bag, exposing the carabiner of each bag generally similar to that shown in FIG. 3 of the drawings. They may then connect each of their respective carabiners to one another, with or without removing the carabiners from the bag member, whereupon the team members are releasably joined together against separating from one another by a distance any greater than the radius provided by the lifeline cord length securing each swimmer to the commonly connected carabiners. This prevents separation and potential loss of one or more of the individual team members, and also serves, by retaining the team in a generally proximate location relative to each other, to facilitate the finding of the team particularly from the air, since seeing multiple persons floating within a predetermined radius is much more likely than seeing individuals scattered more widely.

From the foregoing it will be apparent to those skilled in the art that the present invention provides a personal rescue and extrication apparatus that is conveniently wearable as a standard piece of equipment maintained on the vests of military and other specialized personnel, and provides for both the dragged extrication of an injured wearer, as well as for the emergency rappelling of a trapped wearer in emergency situations. From the foregoing it will also be apparent to those skilled in the art that various changes other than those discussed hereinbefore may be made in the size, shape, type, number and arrangement of parts described hereinbefore without departing from the spirit of this invention and the scope of the appended claims.

Having thus described my invention and the manner in which it may be used, I claim:

1. A personal wear bag lifeline rescue apparatus for securement to apparel securely worn by a wearer in potential need of rescue by being pulled to a different location by other persons, the personal wear lifeline rescue apparatus comprising:

a) a throw bag body member formed of a selected material and having opposite front and rear sides defining an enclosed interior bag cavity therebetween and having an open top end, b) closure means for releasably closing said open top end of said throw bag, c) a loop member fixedly secured within said enclosed interior bag cavity, d) a longitudinally elongated lifeline cord member having a predetermined overall length and secured releasably at one, inner opposite terminal end to said loop member fixedly secured within the bag cavity, and mounting at its opposite, outer, free terminal end a releasable connector member configured for only intentionally-removable securement to the wearer, all but a predetermined outer terminal end portion of said lifeline cord member being releasably contained within said interior bag cavity with said open top end in closed condition, said outer terminal end portion of said lifeline member extending freely therefrom, and e) quick disconnect securing means on said throw bag member for securing the bag member for quick disconnect attachment to the wearer, f) whereby, with the lifeline-containing bag member attached in quick release connection to the wearer and the outer, free terminal end of the lifeline securely attached to the wearer, the bag member may be grasped and pulled off of the wearer and thrown, carried and otherwise extended to a distance from the wearer defined by the predetermined length of the lifeline member secured at its opposite ends to said loop member and the wearer respectively, whereupon the lifeline may be pulled upon by a rescuing person to pull the wearer securely attached thereto to safety.

2. The personal wear lifeline rescue apparatus of claim 1 including connector means for releasably interengaging said loop member fixedly secured within said enclosed interior bag cavity and said one, inner terminal end of the lifeline member.

3. The personal wear lifeline rescue apparatus of claim 2 wherein said bag member is formed of a selected closed cell foam material having a positive buoyancy in water.

4. The personal wear lifeline rescue apparatus of claim 2 wherein said connector means is a carabiner releasably engaging said loop member and said inner terminal end of the lifeline member.

5. The personal wear lifeline rescue apparatus of claim 1 wherein said bag member is formed of a selected closed cell foam material having a positive buoyancy in water.

6. The personal wear lifeline rescue apparatus of claim 1 wherein said quick disconnect securing means for securing the bag member for quick disconnect attachment to the wearer comprises a strip of a selected one component of a hook and loop fastener secured on said front side of the bag member and a strip of the other, corresponding component of a hook and loop fastener secured on said rear side of the bag member for engagement of a selected component with a corresponding component of a hook and loop fastener on an article worn by the wearer.

7. The personal wear lifeline rescue apparatus of claim 1 wherein said quick disconnect securing means for securing the bag member for quick disconnect attachment to the wearer comprises a belt loop flap member fixedly secured at one of its ends to the rear side of the bag member and secured releasably at its opposite end to the rear side of the bag member by interconnecting quick disconnect fastener components, the flap member forming a belt loop for receiving a belt of a wearer to secure the bag member on the belt and to permit removal of the bag member from the supporting belt when said quick release connector components are separated.

* * * * *